United States Patent [19]

Houston et al.

[11] Patent Number: 4,787,237

[45] Date of Patent: Nov. 29, 1988

[54] FAILSAFE TOOL CLAMPING SYSTEM FOR PRESS BRAKE

[75] Inventors: David L. Houston, Hanover Park; John W. Hughes; Terrence M. Pelech, both of Oak Lawn, all of Ill.

[73] Assignee: Accurate Manufacturing Company, Alsip, Ill.

[21] Appl. No.: 901,438

[22] Filed: Aug. 28, 1986

[51] Int. Cl.[4] ..... B21D 37/04

[52] U.S. Cl. ..... 72/462; 72/389; 72/465; 72/481; 403/15

[58] Field of Search ..... 72/389, 462, 465, 481; 403/5, 15, 16

[56] References Cited

U.S. PATENT DOCUMENTS

| | | | |
|---|---|---|---|
| 4,315,425 | 2/1982 | Zbornik et al. | 72/389 |
| 4,506,538 | 3/1985 | Jones, Jr. | 72/389 |
| 4,612,796 | 9/1986 | Smyth, Jr. | 72/389 |

*Primary Examiner*—David Jones

*Attorney, Agent, or Firm*—Fitch, Even, Tabin & Flannery

[57] ABSTRACT

A failsafe hydraulically operated tool clamping system for use on press brakes comprising a series of pressure/-spring actuated piston control units or actuators. These actuators are attached to the press brake tool clamps by a plurality of spaced bolts which extend through the actuators and the fixed and slidable members defining the tool clamps. Compression or Belleville springs urge the fixed and slidable clamp members into tight engage with the tool set punch and die. To open the clamp, pneumatic or hydraulic pressure is applied against the actuator piston thereby overcoming the force exerted by said springs and releasing the punch and die. Both tool set members remain firmly gripped within respective tool clamps in the event of system pressure loss thereby assuring failsafe retention thereof. The lower or bed clamp assembly comprises an L-shaped slidable member and a fixed member with a slot for receiving one leg of the L-shaped member. The design prevents the sliding clamp member from shifting or rocking out of position when the clamp is closed.

5 Claims, 3 Drawing Sheets

FAILSAFE TOOL CLAMPING SYSTEM FOR PRESS BRAKE

BACKGROUND OF THE INVENTION

The present invention relates to a press brake for bending and otherwise forming sheet material. More specifically, the invention relates to a pressure/spring actuated clamping system to secure a punch and die set to a press brake.

Press brakes are industrial devices used to bend or otherwise form sheeted material such as sheet metal. A press brake includes a bed and a ram which is disposed above, and vertically movable over, the bed. Both the ram and bed extend across the entire front portion of the press brake. Clamps for securing a punch and a die (i.e. the tool set) are provided respectively, on both the ram and the bed. The punch extends downwardly from the ram and the die extends upwardly from the bed to matingly receive the punch. Bending or forming of the sheet material or work piece is accomplished by forcefully lowering the ram and punch thereby sandwiching the work piece between the punch and die.

In a typical press brake operation, sheeted material is placed between the punch and die and aligned according to the plans or requirements of the particular job. With the material properly oriented, the ram is moved vertically downward thereby moving the punch toward the die. As the punch is lowered, it contacts the sheeted material and, with adequate force exerted by the ram, the sheeted material is bent or otherwise formed to conform to the shape defined by the mating surfaces of the punch and die. The bends in the sheeted material are unique to the particular tool set combination employed for each job.

Conventionally, the tool set is clamped on the ram and bed by tightening a series of bolts or set screws spaced at approximately twelve inch intervals. A long recognized difficulty with conventional press brakes is the lengthy set-up time required when one tool set is substituted for another. Large press brakes have rams and beds which often exceed 10 to 20 feet in length, consequently, more than a dozen bolts or screws must be loosened and retightened each time the tool set is changed. The problem of set-up time is particularly acute where the tool set must be replaced frequently, that is, where numerous jobs of small lot size are contemplated. Use of large tools, with their correspondingly high number of securement bolts, further aggravate the set-up time problem.

In order to solve this problem, a pressure/spring actutated failsafe clamping system is utilized to eliminate the need for loosening and retightening numerous bolts each time the tool set is changed. The system includes separate bed and ram clamp assemblies; each assembly comprising a fixed and a slidable clamping member. The bed clamp assembly, which is of an interlocking, L-shaped configuration to alleviate misalignment of the tool die upon clamping, is positioned on the bed of a conventional press brake.

It should be noted that pressure actuated clamp mechanisms have been commercially available for some time. Such mechanisms, however, exhibit certain shortcomings for which the present invention was developed to overcome. Specifically, conventional systems require positive pressure to keep the clamp jaws securely closed. In systems of this type, a sudden loss of pressure will cause the clamp jaws to open, potentially releasing the object held therebetween. Such a pressure loss can occur by the rupture or accidental severing of a hydraulic line or upon the interruption of electric service at the site. As many punches do not incorporate additional safety features to assure retention of the punch upon loss of clamping action by the ram clamp, the loss of pressure could result in the release of the punch weighing hundreds of pounds.

The present invention avoids the loss of pressure problem of conventional systems. Specifically, the present invention operates in a failsafe manner by requiring positive pressure to open the clamp jaws. Unlike conventional systems, a sudden loss of pressure will close the clamp jaws thereby avoiding the potentially dangerous situation existing in prior art systems.

Therefore, it is an object of this invention to provide a simple, yet effective, solution to the problems raised by conventional press brake clamps.

It is another object of this invention to reduce the time required to change a tool set on a press brake by eliminating the need to loosen and retighten a series of bolts or set screws every time a tool set is changed.

It is still another object of this invention to provide a pressure/spring actuated clamping system for use on a press brake.

These and other objects and advantages of this invention will become apparent from the remaining portions of this specification.

SUMMARY OF THE INVENTION

The clamping system disclosed herein includes a clamp assembly on both the ram and the bed and a set of one or more pressure actuated control units (actuator means) for controlling both clamp assemblies. Each clamp assembly comprises a fixed member and a sliding member which coact, under the control of the actuators, to provide a clamping action. The bed clamp members interlock to preclude rotary movement of the die upon the clamping retention thereof. Specifically, the sliding clamp member of the bed clamp assembly is L-shaped with one leg of said L-shaped member being received within a recess provided in the fixed bed member. With the clamp closed, the leg of the L-shaped member fits snugly into the recess thereby preventing the sliding member from rotating or rocking out of position while supporting a die tool.

Each actuator is retained in position next to the fixed clamp member of the ram or bed. Retention of said actuator is achieved with a clamp bolt. Pressure tubing is used to link the actuators for simultaneous application of pressure to all actuators. Each actuator comprises a cylinder containing a piston and a compression spring. The clamp bolt extends through the fixed and sliding clamp members, then, axially through the actuator where the actuator is secured in position adjacent to the fixed clamp member by a pair of hex nuts.

The actuator springs serve to provide the necessary clamping force by urging respective actuator pistons against the fixed clamp member which, in turn, force the actuator cylinders and clamp bolts in the opposite direction. This axial movement of the clamping bolt biases the sliding clamp member toward the fixed clamp member thereby engaging the tool die without having to apply pressure to the system. The clamp assembly can be opened by applying sufficient hydraulic or pneumatic pressure to overcome the force of the actuator springs.

BRIEF DESCRIPTION OF THE DRAWINGS

FIG. 3 shows the clamp closed while FIG. 4 shows the clamp open;

FIG. 5 is shown in the clamped position while FIG. 6 is shown in the open or released position;

DETAILED DESCRIPTION OF THE INVENTION

Figure 1:
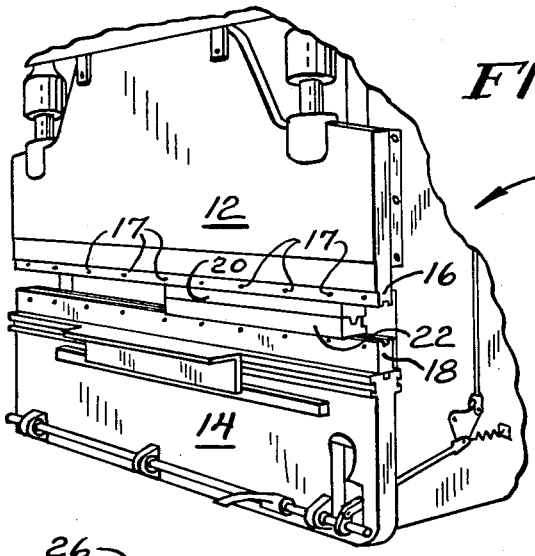
FIG. 1 is a perspective view of a conventional press brake fitted with the hydraulic failsafe clamping system of the present invention.

Referring to FIG. 1, a typical press brake 10 is shown including a ram member 12 and the bed member 14. Both the ram 12 and bed 14 extend across the entire front portion of said press brake 10. The ram 12 is vertically movable over the bed 14 and includes a ram clamp assembly 16 which, in a conventional press brake, incorporates a plurality of independently manipulable bolts at 17 for rigidly securing the tool punch in position below the ram 12. As set forth in more detail below, hydraulic failsafe actuators are placed along the ram corresponding to each of these ram securement bolts. A bed clamp assemby 18 is positioned on the press brake bed to rigidly clamp a tool die.

A tool set comprising a punch 20 and a die 22 is clamped by the ram and bed clamp assemblies 16 and 18, respectively. In a typical press brake operation, sheeted material, such as sheet metal, is placed between the punch 20 and die 22 and oriented therebetween according to the plans or requirements of the particular job. With the sheet material or work piece thusly positioned, the ram member 12 is lowered until the work piece is engaged by both punch and die with sufficient force to bend or otherwise form the work piece according to the shape defined by the mating tool surfaces. The configuration of the bends in the sheeted material is unique to the particular tool set combination employed for each job.

Figure 2:
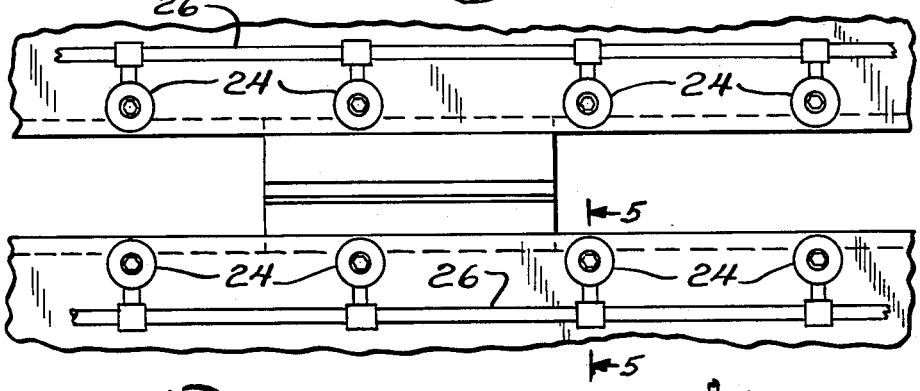
FIG. 2 is a fragmentary rear elevational view of the press brake of FIG. 1 showing the alignment of actuators along the fixed members of both the ram and bed clamping assemblies.

Referring now to FIG. 2, illustration is made of a series of pressure actuated control units or actutators 24. Actuators 24 are attached to both the ram and bed clamp assemblies 16,18. As set forth in more detail below, the actuators are positioned along, and secured to, the ram clamp assembly by bolts extending from the actuators through holes in the ram clamp assembly. Preferably, the actuators will be mounted along the ram utilizing existing holes initially intended to permit manual clamping of the tool punch. Actuators are similarly secured to the bed clamp assembly although it will be noted that conventional press brakes do not utilize such assemblies.

Actuators 24 are interconnected by pressure tubing 26 so that hydraulic or pneumatic pressure may be communicated simultaneously to all of the actuators 24 or, alternatively, to actuator groups corresponding to the ram and bed clamp assemblies, respectively. In the preferred embodiment, the actuators are positioned along the back of the clamp assemblies in order to protect both the actuators 24 and the interconnecting tubing 26 from accidental damage.

Figure 5:
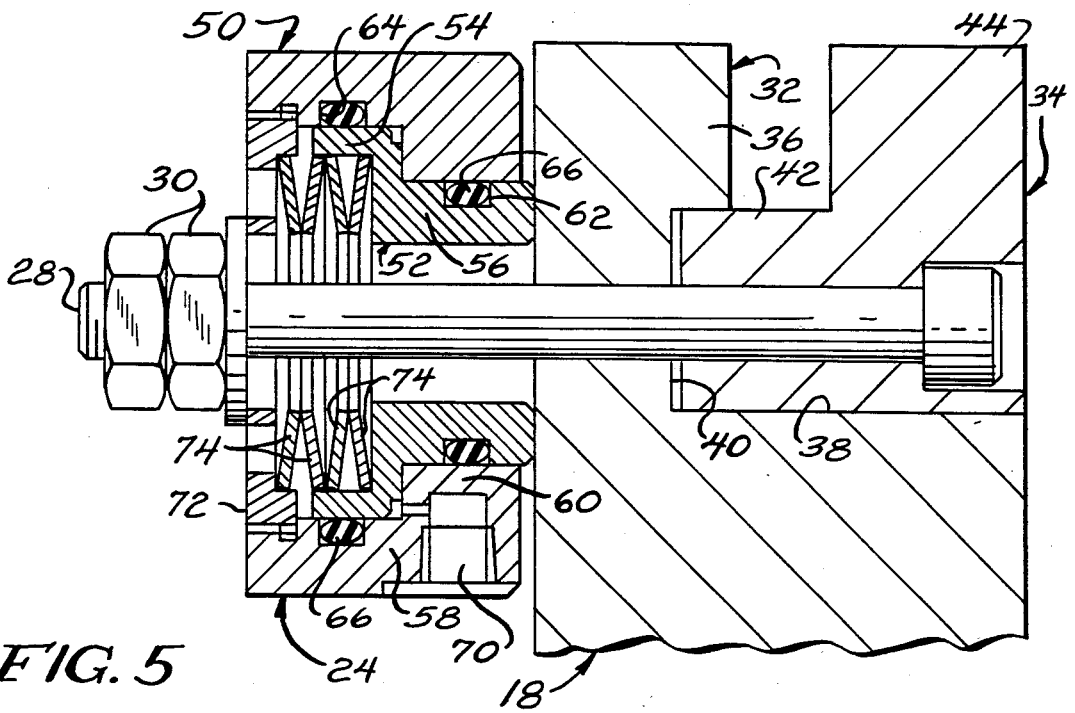
FIGS. 5 and 6 are cross-sectional views of the bed clamp assembly and actuator taken substantially along line 5—5 of FIG. 2.
Figure 6:
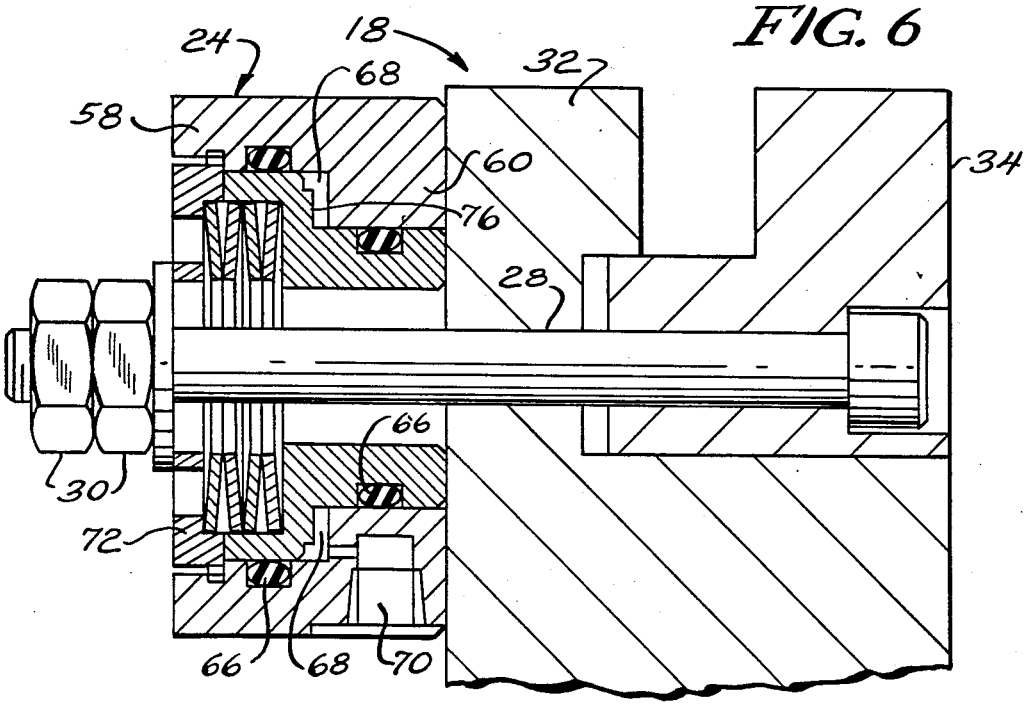

Referring now to FIGS. 5 and 6, an enlarged, cross-sectional view of the bed clamp assembly 18 and actuator 24 according to the preferred embodiment is shown. A clamp bolt 28, which extends through the actuator 24 and the bed clamp assembly 18, secures each actuator in position on the bed clamp assembly. More specifically, a pair of nuts 30 are provided on the end of each bolt 28 to retain the actuator and, as detailed below, to provide an adjustment mechanism by which the maximum axial length of the actuator and bed clamp assembly may be set.

Figure 3:
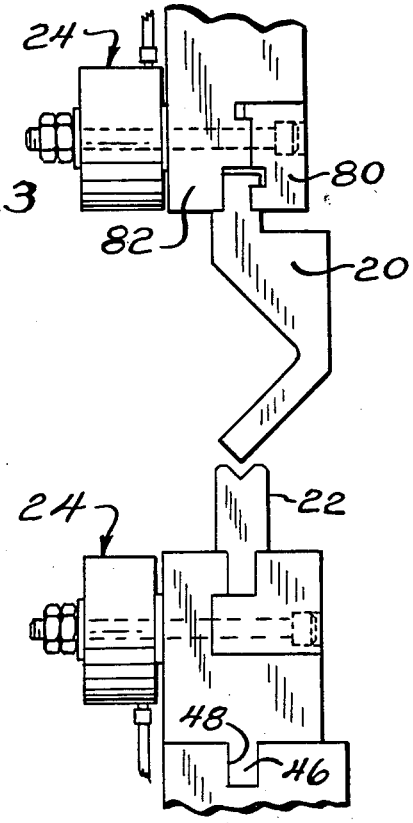
FIGS. 3 and 4 are left elevation views of the clamping system of the present invention.
Figure 4:
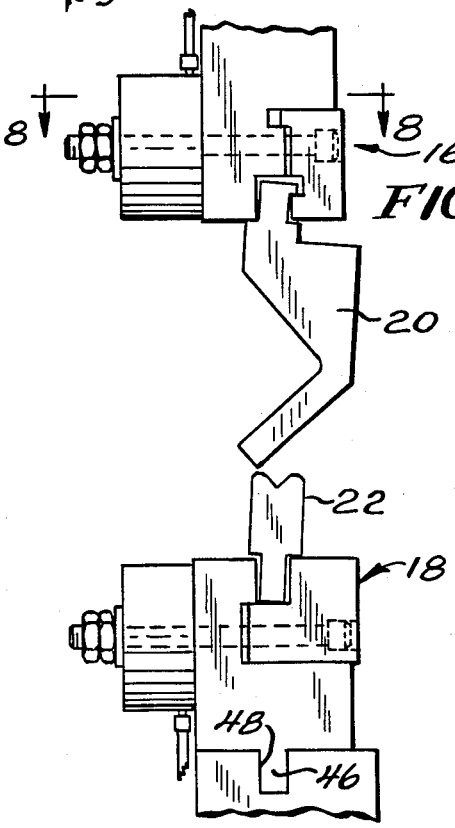

The bed clamp assembly 18 is defined by a fixed bed member 32 and a sliding bed member 34. Importantly, clamp bolts 28 function not merely to secure respective actuators 24 in proper orientation adjacent the bed clamp assembly, but, to effect the relative movement of the fixed and sliding clamp members 32,34 upon operation of the actuators as required to rigidly secure a tool die therein. As discussed below, acutators 24 force the leftward movement of bolts 28, relative to the fixed bed clamp member, which, in turn, cause the corresponding leftward travel of the sliding member 34 thereby clamping a tool die positioned on the bed clamp assembly as illustrated in FIGS. 3 and 4.

Referring to FIG. 5, the fixed bed clamp member 32 defines a vertical jaw 36, adapted to cooperate with the sliding clamp member to grip tools therebetween, and a generally planar horizontal surface 38 on which the sliding clamp member 34 is positioned. A recess 40 is provided along the full inside length of fixed jaw 36, immediately adjacent surface 38, for receipt of a lateral extension 42 of the sliding clamp member 34. As best shown in FIGS. 5 and 6, the recess 40 is defined by a pair of generally horizontal guide surface or wall portions which are vertically spaced and generally face each other to define the recess 40.

In this connection, the sliding clamp member 34 defines an L-shaped cross-section having a vertical jaw 44 and an integral lateral extension 42. The fixed and sliding jaws 36 and 44, respectively, serve to rigidly clamp the tool die 22 therebetween as outlined in more detail below. The vertical height of recess 40 is slightly greater than the corresponding vertical dimension of lateral extension 42 (approximately 0.002–0.003 inch) thereby causing the parallel wall portions and the extension 42 to serve as coacting linear movement guides, facilitating the lateral movement of the sliding clamp member while, importantly, precluding the rotational or lifting movement of that member otherwise found to occur upon tool engagement.

The bed clamp assembly is provided with a tongue 46 along the bottom of the fixed clamp member (FIG. 3) which is adapted to be seated within a complementary recess 48 commonly provided in press brake beds. The bed clamp assembly may be secured to the press brake bed using the conventional system of bolts or set screws.

As shown in FIGS. 5 and 6, each actuator 24 includes an outer casing or cylinder 50 and a piston 52 adapted for axial movement generally within the cylinder. In this connection, and as illustrated in FIG. 5, the piston extends outwardly of the cylinder to effect tool die clamping. Both piston and cylinder comprise two distinct regions charactered by their respective differing diameters. The piston regions 54 and 56, wide and narrow respectively, are adapted for axial movement within corresponding regions 58 and 60 of the cylinder. Annular recesses 62,64 are provided in the narrow region of the piston and in the wide region of the cylinder. O-ring seals 66 are fitted into these recesses which seals, in turn, function to create a pressure-tight chamber 68 (FIG. 6) within the cylinder. A port 70, in pressure communications with chamber 68, is provided through the cylinder of each actuator whereby the chambers may be pressurized. As outlined above, pressure tubing 26 interconnects the various actuators 24 whereby the chambers of the actuators may be simultaneously pressurized.

An end cap 72 is positioned within the wide region of the cylinder, at the outer end thereof. This cap may be retained utilizing conventional screw thread means or, alternatively, a bayonet interlock may be used. One or more compression Belleville-type springs 74 (4 shown) are positioned within the cylinder between the piston and the end cap. As springs 74 are maintained under compression, a continuous biasing-force, preferably in the order of about 600–700 lbs, is applied to the piston urging it to the right until, in the absence of sufficient hydraulic pressure in chamber 68, the wide region of the piston interferingly contacts the narrow cylinder region as shown in FIG. 5. In this orientation, the piston extends outwardly to the right of the cylinder thereby increasing the overall axial length of actuator 24.

Leftward movement of the piston within the cylinder requires the pressurization of chamber 68. Specifically, pressurized hydraulic fluid acting against the radial surface 76 of the piston generates a leftward axial force on the piston. As shown in FIG. 6, the piston is moved to the left and the tool die is released when hydraulic pressure sufficient to overcome spring 74 is applied. Commercial actuators may be employed with the present invention, for example, an Enerpac, Toyo Hydraulic Equipment Co., Ltd,, model WRS-75 QBC clamp.

Operation of the present clamping system is best shown by reference to FIGS. 3–6 in which FIGS. 3 and 5 illlustrate the assembly in the clamped state while FIGS. 4 and 6 show the assembly in the unclamped state. A clamping force is provided, as previously noted, by compression springs 74 which urge piston 52 against the surface of fixed bed clamp member 32 thereby forcing the actuator cylinder 50 and bolt 28 leftward with reference to the piston and, importantly, the fixed member 32 of the bed clamp assembly. This, in turn, forces the sliding clamp member 34 to correspondingly move leftward until the tool die 20 is engaged between the clamp members as shown in FIG. 3.

The die is rigidly held within the bed clamp assembly by reason of the plurality of actuators, spaced along the assembly at approximately 12 inch intervals. Each actuator applies its full spring force of 600–700 lbs to the clamp assembly. Significantly, full tool clamping action is achieved by the internal actuator springs 74 without application of hydraulic pressure. Indeed, hydrualic pressure is required to release, rather than clamp, the tools and, therefore, it will be appreciated that the present arrangement provides for failsafe tool clamping; that is, maintains full tool clamping, in the face of an unexpected loss of hydraulic pressure.

Referring to FIGS. 4 and 6, the bed clamp assembly 18 is shown with members 32 and 34 in the open position. To open the clamp assembly, pressurized hydraulic fluid, generally in excess of 1000 psi, is applied simultaneously to the actuators 24 as set forth above. This pressure is sufficient to overcome the force exerted by compression springs 74 thereby causing pistons 52 to withdraw leftward within cylinders 50. This, in turn, releases the clamping force applied through bolt 28 to the sliding clamp member 34. The tool die 22 may be removed.

The above discussion has been specifically directed to the bed clamp assembly. It will be noted, however, that the ram of the press brake utilized a clamping arrangement similar to that just discussed including sliding and fixed ram clamp members 80 and 82 (FIGS. 3 and 4), respectively, and identical actuators 24. Installation of the actuators on the ram 12 requires only the removal and replacement of each existing ram clamp bolt with an actuator 24 and longer clamp bolt 28. FIG. 3 shows both clamp assemblies, with hydraulic pressure removed, rigidly securing the respective tools while FIG. 4 shows both clamp assemblies, with hydraulic pressure applied, open thereby permitting the removal of the tools. A hydraulic (or pneumatic) pressure source is required, as outlined above, to affect release of tools by the clamp assemblies. Such pressure sources, however, are well known and available commercially and, therefore, will not be considered further herein.

Figure 7:
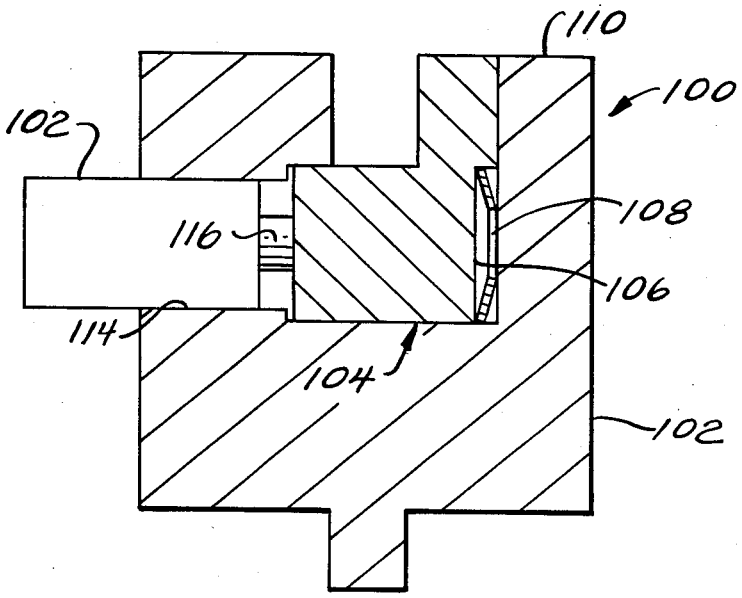
FIG. 7 is a cross-sectional view of an alternative embodiment of the bed clamp assembly of the present invention taken along line 5—5 of FIG. 2; and, FIG. 8 is a cross-sectional view of an alternative embodiment of the ram clamp assembly taken along line 8—8 of FIG. 4.
Figure 8:
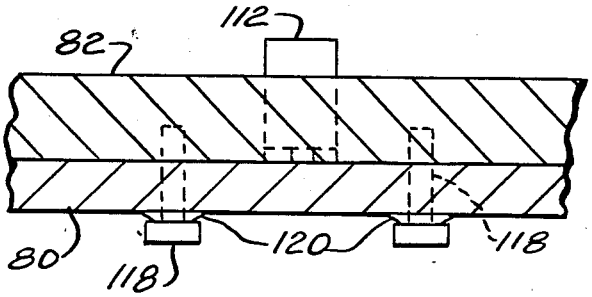

FIGS. 7 and 8 illustrate another embodiment of the present invention in which the actuators 24 are replaced by separate clamping bias springs and hydraulic cylinders. FIG. 7 depicts the bed clamp assembly 100 according to this second embodiment including a U-shaped fixed bed clamp member 102. The clamp member 102 has a recess therein in which recess is supported an L-shaped sliding bed clamp member 104. Clamp member 104 is similar to the clamp member 34 considered above except that a plurality of spaced spring recesses 106 are provided along the length of clamp member 104 to receive the Belleville-type compression springs 108 therein.

The fixed clamp member 102 is also similar to the previously considered member 32 except that member 102 includes a generally vertical wall portion or tongue or back-stop 110 adjacent the recess against which the compression springs 108 act thereby urging the sliding member 104 leftward into clamping engagement with the die.

A plurality of hydraulic push cylinders 112 are spaced along the fixed clamp member 102. Hydraulic cylinders 112 are of conventional design and include external threads to be received within the internally threaded holes 114 spaced along the fixed clamp member. Cylinders 112 are interconnected, as previously discussed, to a source of hydraulic pressure. Upon pressurization, a piston, with shaft 116 connected thereto, is urged to the right which, in turn, forces the corresponding sliding movement of clamp member 104 thereby releasing the die (not shown) therein.

FIG. 8 illustrates the alternative embodiment of the present invention as applied to the ram clamp assembly. Push cylinders 112 are threaded into existing holes spaced along the fixed ram clamp member 82. These cylinders, as explained with respect to the bed clamp assembly above, urge the sliding ram clamp member 80 outwardly upon pressurization of the cylinders 112 thereby releasing the punch.

The sliding ram clamp member 80 is retained adjacent the fixed clamp member by a plurality of spaced bolts 118 threadably received in the fixed clamp member. A Belleville-type compression spring 120 is positioned between each bolt 118 and the sliding clamp member. These springs, acting against the respective bolts, force the sliding clamp member into tight engagement with the fixed clamp member or punch therein.

It will be appreciated that the second embodiment of the present invnetion also provides for fail-safe operation in that hydraulic pressure is required to overcome the clamping action of the Belleville compression springs. If hydraulic pressure is lost or inadvertently removed, the punch and die set remain firmly clamped in operative position. It will be further appreciated that the second embodiment similarly positions the hydraulic cylinder and requisitie hydraulic interconnection lines behind the ram and bed thereby minimizing the likelihod of damage thereto during normal press brake operation.

Use of the disclosed system will eliminate the need for loosening and retightening a series of bolts or set screws every time the tool set is changed. By requiring positive pressure to open the press brake clamps the possibility of accidental clamp opening is virtually eliminated. Further, the new bed clamp assembly described above will prevent the sliding clamp member from shifting out of position when the clamp is closed. It will be understood that changes may be made in details of construction, arrangement and operation without departing from the spirit of the invention, especially as defined in the following claims.

We claim:

1. A failsafe pressure/spring actuated clamping system for press brakes of the type including a stationary bed for receiving a first tool member thereon and a vertically movable ram, above the bed, for receiving a second tool member therebelow, the press brake adapted to bend or otherwise form material positioned between the tool members; the clamping system including a bed clamp assembly and a ram clamp assembly, said assemblies being secured to the bed and ram, respectively; one of said clamp assemblies comprising a first substantially stationary clamp member and a second sliding clamp member supported adjacent said first clamp member for substantially linear movement with respect thereto; said clamp members each including respective linear movement guide means coacting with each other for guiding the second clamp member in said substantially linear movement, one of said linear movement guide means comprising a pair of generally horizontal vertically spaced guide wall portions defining a recess therebetween, and the other of the linear movement guide means comprising an extension portion extending within said recess and being engageable with said wall portions to guide the second clamp member in sliding linear movement during clamping of the tool member; and acutator means for moving the second clamp member in relation to the first clamp member whereby the associated tool member may be selectively retained and released; said actuator means comprising a plurality of spring means spaced along the clamp assembly for biasing the sliding and stationary clamp members into clamping engagement with the associated tool member; said actuator means including pressure operated means for overcoming the spring means biasing force thereby releasing the tool member from the clamp assembly whereby a positive pressure must be applied to the pressure operated means to release the tool member secured within the clamp assembly and whereby the tool member is fixedly secured within the clamp assembly upon removal of pressure from the pressure operated means.

2. A failsafe pressure/spring actuated clamping system for press brakes of the type including a stationary bed for receiving a first tool thereon and a vertically movable ram, above the bed, for receiving a second tool therebelow, the press brake adapted to bend or otherwise form material positioned between the tools; the clamping system including a bed clamp assembly and a ram clamp assembly, said assemblies being secured to the bed and ram, respectively; one of said clamping assemblies comprising a first clamp member having a recess therein; said first clamp member having a generally vertical back-stop wall portion adjacent said recess; a second clamp member supported in said recess adjacent said back-stop wall portion for substantially linear lateral movement therein relative to the first clamp member for clamping and releasing the associated tool; actuator means operatively associated with said clamp assembly for selectively securing and releasing the associated tool, the actuator means including compression spring means engaging said back-stop wall portion and said second clamp member, said compression spring means biasing the second clamp member to move away from the backstop wall portion and into clamping engagement with the tool, and pressure operated means for releasing the tool operatively associated with the second clamp member and moving the second clamp member away from clamping engagement with the tool when pressurized whereby failsafe tool securement is maintained upon the removal of pressure from the pressure operated means.

3. A failsafe pressure/spring actuated clamping system for press brakes of the type including a stationary bed for receiving a die thereon and a vertically movable ram, above the bed, for receiving a punch therebelow, the press brake adapted to bend or otherwise form material positioned between the punch and die; the clamping system including a bed clamp assembly and a ram clamp assembly, said assemblies being secured to the bed and ram, respectively; actuator means operatively associated with each clamp assembly for selectively securing and releasing the tool punch and die; the bed clamp assembly comprising elongate first stationary and second sliding clamp members, the first clamp member including a first clamping jaw extending upwardly therefrom; the second clamp member having a generally L-shaped cross-section defined by a body portion and a second clamping jaw extending upwardly therefrom, the body portion being disposed between the first and second clamping jaws, the tool die being secured between the first and second jaws; the first jaw having a lower portion including linear movement guide means for guiding the second clamp member in substantially linear movement in a direction transverse tgo the elongate axis, said guide means including a pair of generally planar horizontal guide surfaces, said surfaces being spaced vertically from one another and defining an elongate recess therebetween said recess receiving the body portion of the second clamp member during securement of the tool and the body portion engaging the guide surfaces, whereby the guide means precludes angular movement of the second clamping member about the elongate axis upon tool clamping thereby assuring proper alignment of the tool die in the bed clamp assembly, the actuator means comprising biasing means for urging the second clamp member into clamping engagement with the tool die, and release means configured for selective activation by an operator to release the tool die, said release means moving the second clamp member away from clamping engagement with the tool die when the release means is activated to release the tool die.

4. The failsafe pressure/spring actuated clamping system of claim 3 wherein the bed clamp assembly first clamp member includes an elongate wall extending upwardly from the the lower horizontal guide surface, the wall being disposed in opposed relationship to the first jaw whereby the first clamp member is generally U-shaped, the second clamp member being positioned for sliding movement on the first clamp member between the wall and first jaw; and the biasing means including compression spring means engaging the first clamp member wall and the second clamp member, said spring means urging the first and second jaws into clamping engagement of the tool die positioned within the jaws, and said release means including pressure operated cylinder means rigidly affixed to the first clamp member, the cylinder means including a piston means in operative engagement with the second clamp member, the piston means being urged outwardly from the cylinder means when pressure is applied to the cylinder means whereby application of pressure to the cylinder means acts against the spring means thereby releasing the tool die.

5. A failsafe pressure/spring actuated clamping system for press brakes of the type including a stationary bed for receiving a die tool thereon and a vertically movable ram, above the bed, for receiving a punch tool therebelow, the press brake adapted to bend or otherwise form material positioned between the punch and die tools; the clamping system including a bed clamp assembly and a ram clamp assembly, said assemblies being secured to the bed and ram, respectively; each clamp assembly comprising a first clamp member and a second clamp member supported thereon, said first clamp member having guide means comprising a pair of generally horizontal planar guide surfaces spaced vertically from each other and defining a generally horizontally extending guide recess therebetween; said second clamp member having an extension portion extending within said guide recess and slidingly engaging said guide surfaces in substantially linear movement relative to said first clamp member; a plurality of actuator means spaced along, and operatively interconnected with, each clamp assembly for selectively securing and releasing the punch and die tools, each actuator means comprising a piston and cylinder wherein movement of the piston in a first direction with respect to the cylinder secures tools positioned in the clamp assembly and movement of the piston in the opposed second direction releases a tool therein; the piston and cylinder including seal means thereby defining a pressure chamber between the piston and cylinder, pressurization of the pressure chamber urges the piston in the second tool release direction; spring means operatively disposed between the piston and cylinder, the spring means applying a biasing force urging the piston in the first direction whereby tools are secured in the clamp assemblies by the force of the spring means when no pressure is applied to the pressure chamber and released from the clamp assemblies when the pressure in the pressure chamber exceeds the force of the biasing spring means.

* * * * *